US008021055B2

(12) United States Patent
Bradshaw et al.

(10) Patent No.: US 8,021,055 B2
(45) Date of Patent: Sep. 20, 2011

(54) MECHANICAL LOCK FOR ROLLING MILL OIL FILM BEARING

(75) Inventors: Timothy J. Bradshaw, North Grafton, MA (US); Armando S. Martins, Cumberland, RI (US)

(73) Assignee: Siemens Industry, Inc., Alpharetta, GA (US)

( * ) Notice: Subject to any disclaimer, the term of this patent is extended or adjusted under 35 U.S.C. 154(b) by 648 days.

(21) Appl. No.: 12/193,081

(22) Filed: Aug. 18, 2008

(65) Prior Publication Data

US 2009/0060404 A1 Mar. 5, 2009

Related U.S. Application Data

(60) Provisional application No. 60/969,995, filed on Sep. 5, 2007.

(51) Int. Cl.
*F16C 43/04* (2006.01)

(52) U.S. Cl. ..... 384/562; 384/556

(58) Field of Classification Search ..... 384/126, 384/127, 128, 158, 191.3, 191.4, 537, 540, 384/556, 561, 562, 584, 585, 559; 403/1, 403/183, 199, 337

See application file for complete search history.

(56) References Cited

U.S. PATENT DOCUMENTS

| | | | | |
|---|---|---|---|---|
| 2,065,614 | A | 3/1935 | Scribner | |
| 2,405,745 | A | 12/1944 | Haager | |
| 2,606,799 | A | 8/1950 | Weckstein | |
| 3,080,199 | A * | 3/1963 | Rickley | 384/584 |
| 3,798,926 | A | 3/1974 | Weible | |
| 3,799,636 | A | 3/1974 | Kersting et al. | |
| 3,822,081 | A | 7/1974 | Mercer et al. | |
| 4,191,042 | A | 3/1980 | Salter, Jr. | |
| 4,834,560 | A | 5/1989 | Jacob et al. | |
| 6,132,101 | A * | 10/2000 | Landy, III | 384/559 |
| 6,892,562 | B2 * | 5/2005 | Gethings | 72/237 |
| RE39,027 | E * | 3/2006 | Johnson et al. | 384/537 |
| 7,017,381 | B2 * | 3/2006 | Gethings | 72/237 |
| 7,500,374 | B2 * | 3/2009 | Martins et al. | 72/245 |
| 2005/0254737 | A1 * | 11/2005 | Scheffe et al. | 384/126 |

FOREIGN PATENT DOCUMENTS

| | | |
|---|---|---|
| EP | 050530 | 9/1984 |

* cited by examiner

*Primary Examiner* — Thomas R Hannon
*Assistant Examiner* — Alan Waits

(57) ABSTRACT

An oil film bearing is seated on the tapered neck of a rolling mill roll by a hydraulically actuated piston/cylinder unit. The piston/cylinder unit is axially confined by externally threaded locking arms seated in a groove in the roll neck. A locknut is threaded onto the locking arms.

7 Claims, 4 Drawing Sheets

MECHANICAL LOCK FOR ROLLING MILL OIL FILM BEARING

PRIORITY INFORMATION

This application claims priority from provisional application Ser. No. 60/969,995 filed Sep. 5, 2007, which is incorporated herein by reference in its entirety.

BACKGROUND OF THE INVENTION

1. Field of the Invention

This invention relates generally to rolling mill oil film bearings, and is concerned in particular with an improved mechanical lock for use in conjunction with the hydraulically actuated piston/cylinder assemblies employed to mount the bearings.

2. Description of the Prior Art

Oil film bearings are well known and widely employed throughout the rolling mill industry. Also known is the use of hydraulic piston/cylinder assemblies that are incorporated as integral components of the bearing assemblies, and that are used to urge the bearings onto the roll necks.

The present invention is concerned with the provision of an improved mechanical locking arrangement for use in concert with such piston/cylinder assemblies to insure that the bearings are securely mounted and remain securely anchored in their seated positions on the roll necks.

SUMMARY OF THE INVENTION

In accordance with the present invention, an oil film bearing is provided for use on a rolling mill roll that has a tapered neck leading to a cylindrical extension, with a circular neck groove in the cylindrical extension axially deliminated by inboard and outboard shoulders. An internally tapered sleeve is received in a seated position on the tapered roll neck. The sleeve is journalled for rotation in a bushing fixed within a chock. A piston surrounds the neck groove, and a cylinder surrounds and is internally subdivided by the piston into first and second chambers. Thrust components are interposed axially between the sleeve and the cylinder. Externally threaded locking arms are pivotally connected to the piston, and are adjustable between unlocked positions removed from the neck groove, and locked positions received in the neck groove and axially confined inwardly of the neck groove's outboard shoulder. A locknut is configured and dimensioned to be threaded onto the locking arms and into an engaged position retaining the locking arms in their locked positions within the neck groove. With the locknut in its engaged position, pressurization of the first cylinder chamber will result in the cylinder being urged axially in an inboard direction to exert a mounting force acting via the thrust components to urge the sleeve into its seated position, with outboard axial movement of the piston being resisted by engagement of the locking arms with the outboard shoulder of the neck groove.

Pressurization of the second cylinder chamber will serve to relieve the mounting force. The locking arms are externally configured with outboard partially cylindrical lands leading to threaded segments. When the locking arms are in their locked positions, the lands serve to guide the locknut into threaded engagement with the threaded locking arm segments. The locknut is rotationally fixed in its engaged position by means of a key received in a keyway in the roll neck. Preferably, spring loaded plungers are circumferentially spaced on the inboard side of the sleeve. The plungers serve to interact with the thrust components in generating the mounting force axially urging the sleeve into its seated position on the tapered section of the roll neck.

DETAILED DESCRIPTION

Figure 1:
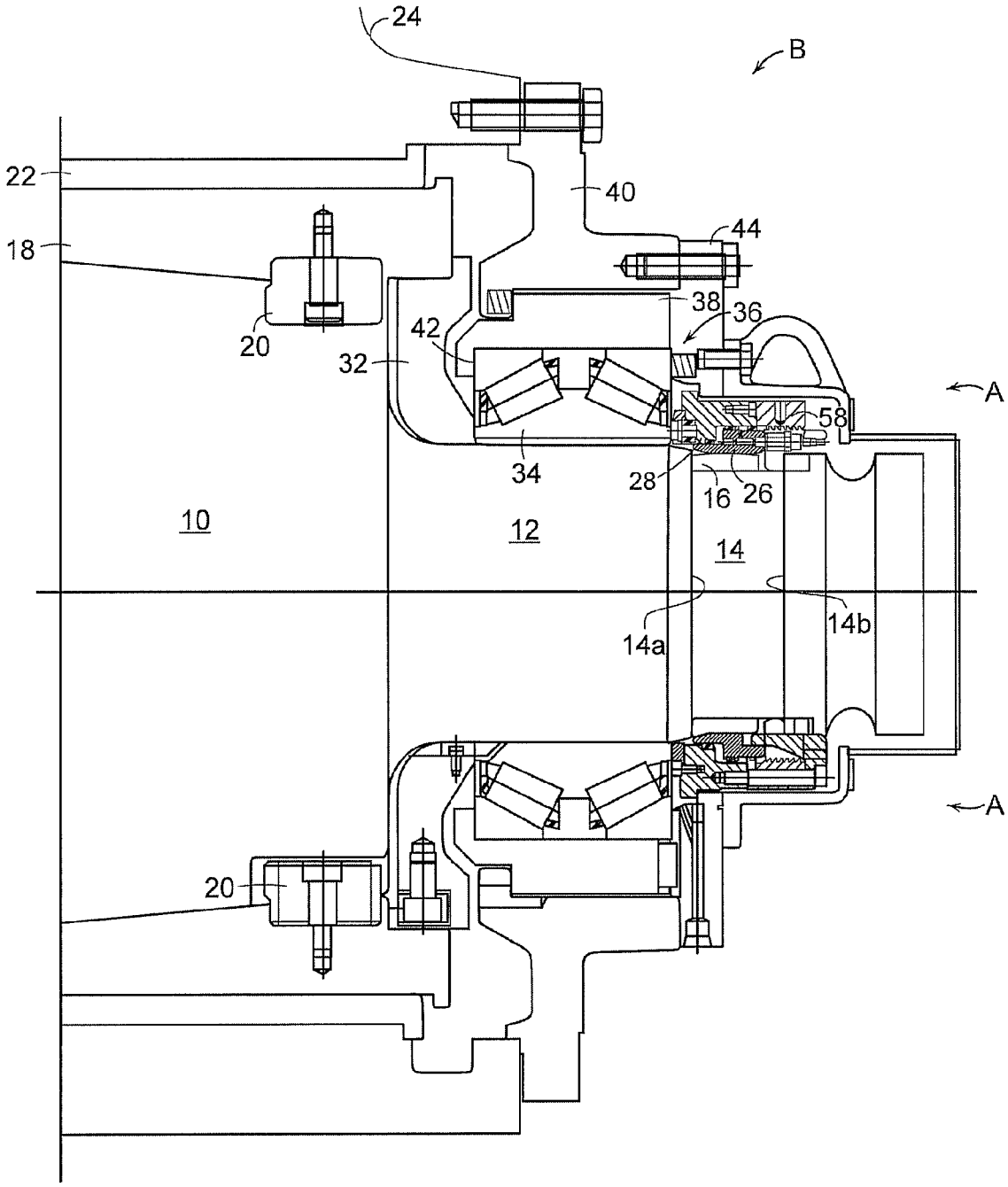
FIG. 1 is a sectional view through an oil film bearing incorporating a mechanical lock in accordance with the present invention.
Figure 2:
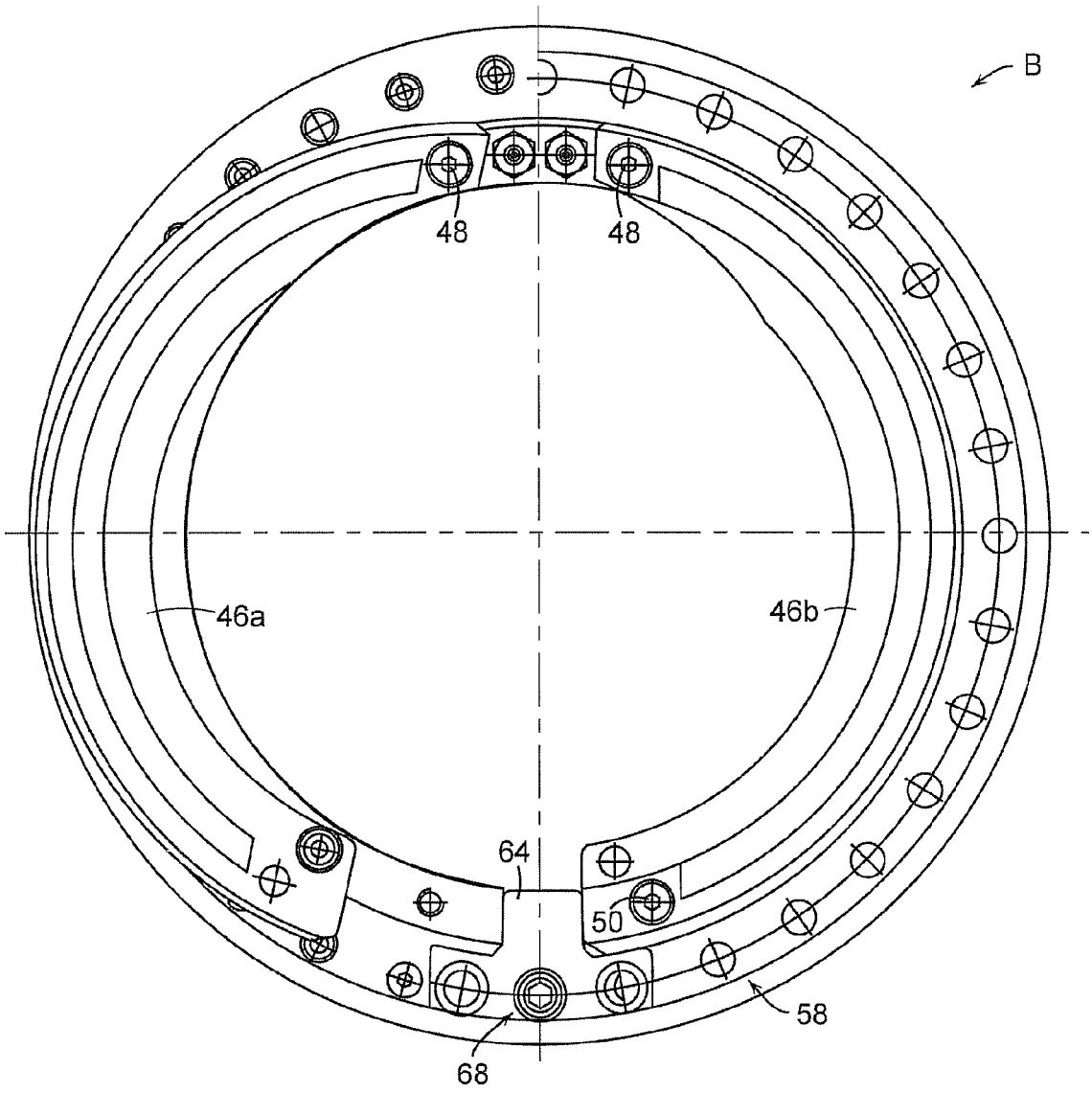
FIG. 2 is a split end view taken on line A-A of FIG. 1, the left hand side of which shows the locknut removed and the locking arm in its open position, and the right hand side of which shows the locknut threaded onto the closed locking arm.

With reference initially to FIGS. 1 and 2, an oil film bearing "B" is shown for a rolling mill roll with a tapered neck 10 leading to a reduced diameter cylindrical end section 12. A groove 14 in the reduced diameter end section 12 is partially filled with a filler ring 16. The groove 14 is axially deliminated by inboard and outboard shoulders 14*a*, 14*b*. The oil film bearing B includes an internally tapered sleeve 18 seated on the tapered neck 10 and rotationally fixed in place by keys 20. The sleeve is journalled for rotation in a bushing 22 fixed within a chock 24, and in operation, a film of oil (not shown) is hydrodynamically maintained between the sleeve and bushing at the bearing load zone.

A piston 26 surrounds the groove 14, and a cylinder 28 and associated cap 29 surrounds the piston. As can best be seen by additional reference to FIGS. 3-5, the cylinder 28 is internally subdivided by the piston into first and second chambers 30*a*, 30*b*. Thrust components including a sleeve ring 32 and the inner race 34 of a roller thrust bearing 36 are interposed axially between the sleeve 18 and the cylinder 28. The roller thrust bearing has an outer retainer 38 surrounded by a collar 40 connected to the chock 24. The retainer overlaps the inboard end of the thrust bearing as at 42, and the outboard end of the thrust bearing is confined by an end plate 44 connected to the collar 40.

As can best be seen in FIG. 2, locking arms 46*a*, 46*b* are pivotally connected as at 48 to the outboard end of the piston 26. Locking arm 46*a* is shown in an open condition removed from groove 14, whereas locking arm 46*b* is shown closed and seated in the groove. When closed, the locking arms 46*a*, 46*b* are confined axially by the outboard shoulder 14*b* of the groove 14 and radially by shoulder screws 50, one being shown in FIG. 2.

Preferably, multiple circumferentially spaced spring loaded plungers 54 are carried by the inboard end of the cylinder 28. Hydraulically pressurizing chamber 30*a* urges the locking arms 46*a*, 46*b* against the adjacent outboard shoulder 14*b* of groove 14 while urging the cylinder 28 in the opposite direction. The cylinder will thus act via the plungers 54, the inboard race 34 of the thrust bearing 36 and the sleeve ring 32 to exert a mounting force urging the sleeve 18 into its seated position on the tapered neck section 10. Conversely, hydraulically pressurizing chamber 30*b* serves to relieve the mounting force.

Figure 5:
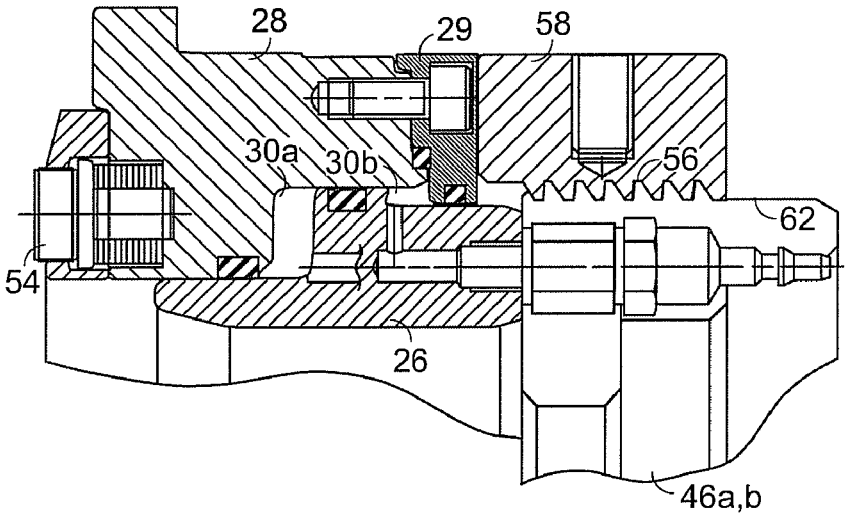

The locking arms 46*a*, 46*b* are externally threaded as at 56 and are mechanically held in their closed positions seated in groove 14 by a lock nut 58 (shown in its locked position threaded onto the locking arms in FIGS. 1, 2, and 5).

Figure 3:
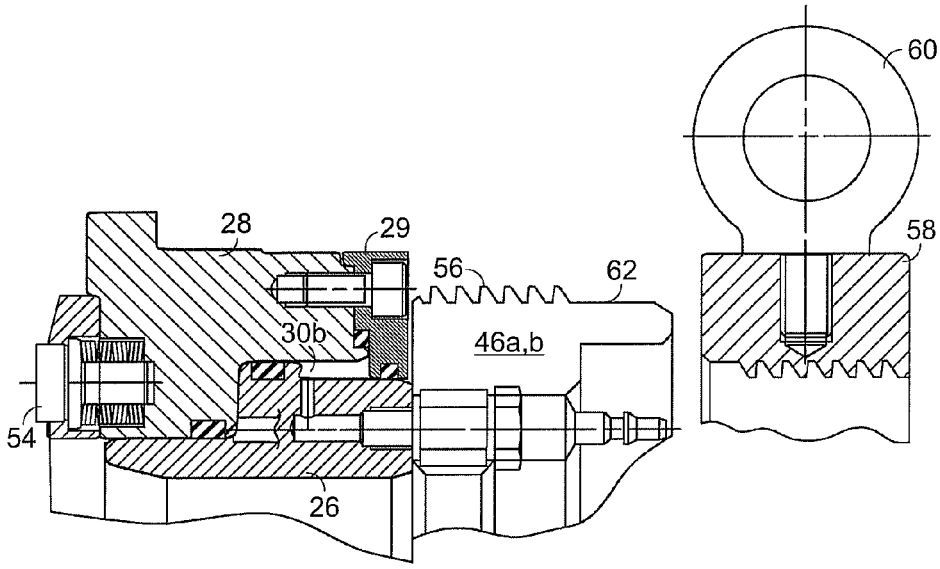
FIGS. 3-5 are enlarged partial sectional views showing sequential steps in the engagement of the mechanical lock.

The procedure for mounting the lock nut begins with the components arranged as shown in FIG. 3, with the cylinder 28 retracted, the locking arms open, and the locknut 58 suspended by means (not shown) attached to a lifting eye bolt 60.

Figure 4:
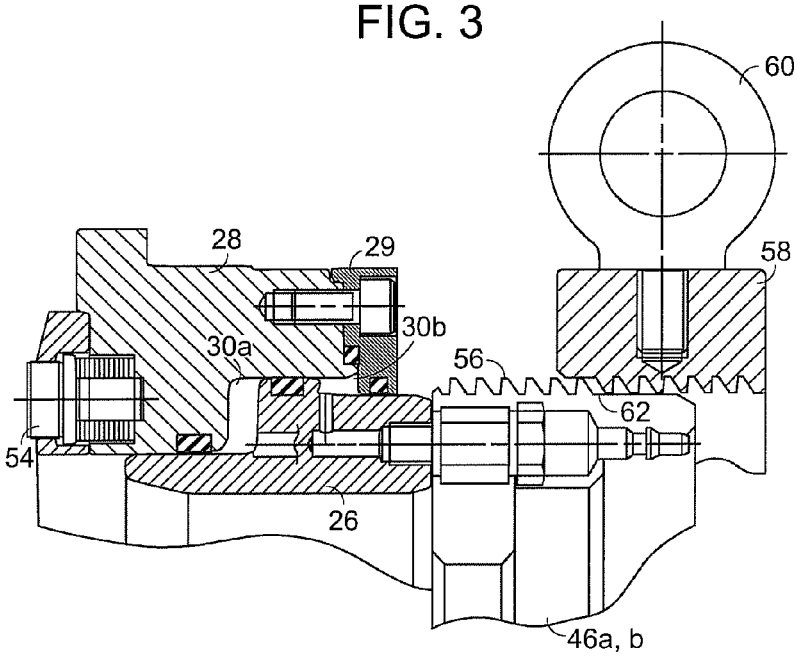

As shown in FIG. 4, after the locking arms 46*a*, 46*b* have been closed and cylinder chamber 30*a* has been pressurized to advance the cylinder 28 and to axially urge the sleeve 18 onto the roll neck, as described previously, the lock nut 58 then is seated on unthreaded lands 62 projecting axially from the threaded sections of the locking arms.

Figure 6:
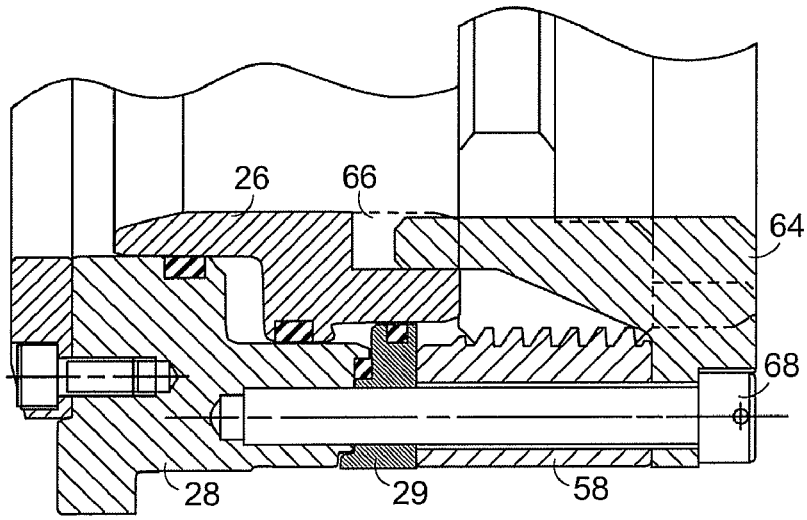
FIG. 6 is an enlarged partial sectional view showing the keyed interconnection between the piston and cylinder.

Then, as shown in FIG. 5, the lock nut 58 is threaded onto the lock arms 46*a*, 46*b* and advanced to its locked position abutting the outboard end of the cylinder 28. Once this has been accomplished, and as shown in FIG. 6, means for rotationally fixing said lock nut in said engaged position are provided. The means for rotationally fixing said lock nut comprises a key 64 being inserted in a keyway 66 in the piston 28. Means for connecting said key to said lock nut are provided to prevent relative rotation between said piston and said cylinder, wherein said means for connecting comprises the key 64 being connected to the cylinder 28 by a screw 68.

Dismounting the bearing is accomplished by reversing the above described procedure. More particularly, the key 64 is initially removed, followed by pressurizing cylinder chamber 30*b* to relieve the mounting force. Thereafter, the lock nut 58 is removed and the locking arms 46*a*, 46*b* are opened, thus freeing the bearing for removal from the roll neck.

In light of the above, it will now be appreciated that the present invention embodies significant and advantageous features. Of prime importance is the secure retention of the locking arms 46*a*, 46*b* in the neck groove 14 by the locknut 58. Also of importance is the role of the unthreaded lands 62 which serve to guide and align the locknut for engagement with the threaded sections 56 of the locking arms.

We claim:

1. An oil film bearing for a rolling mill roll having a tapered neck leading to a cylindrical extension, with a circular groove in said cylindrical extension axially deliminated by inboard and outboard shoulders, said bearing comprising:

an internally tapered sleeve received in a seated position on said tapered neck, said sleeve being journalled for rotation in a bushing fixed within a chock;

a piston surrounding the circular groove in said cylindrical extension;

a cylinder surrounding and internally subdivided by said piston into first and second chambers;

thrust components interposed axially between said sleeve and said cylinder;

externally threaded locking arms pivotally connected to said piston, said locking arms being adjustable between unlocked positions removed from said circular groove, and locked positions received in said groove and axially confined inwardly of said outboard shoulder; and a locknut configured and dimensioned to be threaded onto said locking arms and into an engaged position retaining said locking arms in their locked positions within said groove, whereupon, with said locknut in said engaged position, pressurization of said first chamber will result in said cylinder being urged axially in an inboard direction to exert a mounting force acting via said thrust components to urge said sleeve into said seated position, with outboard axial movement of said piston being resisted by engagement of said locking arms with the outboard shoulder of said groove.

2. The oil film bearing of claim 1 wherein pressurization of said second chamber will serve to relieve said mounting force.

3. The oil film bearing of claim 1 or 2 wherein said locking arms are externally configured with outboard partially cylindrical lands leading to threaded segments, said lands having surfaces serving to be received in and to guide said locknut into threaded engagement with said threaded segments when said locking arms are in their locked positions.

4. The oil film bearing of claim 1 or 2 further comprising means for rotationally fixing said locknut in said engaged position.

5. The oil film bearing of claim 4 wherein said means for rotationally fixing said locknut comprises a key seated in a keyway in said piston, and means for connecting said key to said lock nut.

6. The oil film bearing of claim 5 wherein said means for connecting said key to said lock nut also connects said key to said cylinder.

7. The oil film bearing of claim 1 further comprising spring loaded plungers circumferentially spaced on an inboard side of said sleeve, said plungers serving to interact with said thrust components in generating said mounting force to axially urge said sleeve into said seated position on the tapered neck.

* * * * *